US012742272B2

(12) United States Patent
Hutin et al.

(10) Patent No.: US 12,742,272 B2
(45) Date of Patent: Sep. 22, 2026

(54) FACILITY FOR PRODUCING MINERAL WOOL

(71) Applicant: SAINT-GOBAIN ISOVER, Courbevoie (FR)

(72) Inventors: Vincent Hutin, Aubervilliers (FR); Mihai Manzat, Aubervilliers (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 250 days.

(21) Appl. No.: 18/548,534

(22) PCT Filed: Mar. 2, 2022

(86) PCT No.: PCT/FR2022/050371
§ 371 (c)(1),
(2) Date: Aug. 31, 2023

(87) PCT Pub. No.: WO2022/185010
PCT Pub. Date: Sep. 9, 2022

(65) Prior Publication Data

US 2024/0141565 A1 May 2, 2024

(30) Foreign Application Priority Data

Mar. 2, 2021 (FR) ..... 2102034

(51) Int. Cl.
*D04H 1/4226* (2012.01)
*D04H 1/74* (2006.01)

(52) U.S. Cl.
CPC ..... *D04H 1/4226* (2013.01); *D04H 1/74* (2013.01)

(58) Field of Classification Search
CPC .. D04H 1/95; D04H 1/07; D04H 1/48; D04H 1/42; D04H 1/04; D04H 1/09; D04H 1/74; D01G 25/00
See application file for complete search history.

(56) References Cited

U.S. PATENT DOCUMENTS 4,847,022 A * 7/1989 Bold ..... B27N 3/14 264/109
6,233,787 B1 * 5/2001 Eriksen ..... D01G 25/00 19/296

(Continued)

FOREIGN PATENT DOCUMENTS

CN 111058179 A * 4/2020 ..... C03C 25/465
EP 0013868 A1 * 8/1980 ..... D04H 1/4209

(Continued)

OTHER PUBLICATIONS

International Search Report as issued in International Patent Application No. PCT/FR2022/050371, dated Jun. 15, 2022.

*Primary Examiner* — Erin Snelting
*Assistant Examiner* — Steven S Lee
(74) *Attorney, Agent, or Firm* — CUSHMAN PARTNERS, LLC

(57) ABSTRACT

A facility for producing mineral wool, including at least one supply device for supplying mineral fibers and a fiber-distribution station including a conveyor belt which can move in a longitudinal direction and on which the mineral fibers can be received so as to form a mineral fiber mat, wherein the fiber distribution station includes a roller table arranged on the passage of the mineral fibers that are intended to fall by gravity onto the conveyor belt, wherein each roller can be driven in rotation about a transverse axis of rotation, the rollers being configured to orient the mineral fibers longitudinally on the conveyor belt.

20 Claims, 3 Drawing Sheets

(56) References Cited

U.S. PATENT DOCUMENTS

| | | | | |
|---|---|---|---|---|
| 7,487,573 | B2 * | 2/2009 | Celli | D04H 1/72 19/304 |
| 7,491,354 | B2 * | 2/2009 | Andersen | D04H 1/4209 264/518 |
| 8,793,840 | B2 * | 8/2014 | Schwarz | D01G 25/00 19/296 |
| 9,580,848 | B2 * | 2/2017 | Henderson | D04H 1/49 |
| 2005/0098910 | A1 * | 5/2005 | Andersen | D04H 1/4209 425/72.2 |
| 2010/0283176 | A1 * | 11/2010 | Eriksen | D04H 1/732 425/373 |
| 2011/0247838 | A1 * | 10/2011 | Endle | C04B 35/80 169/45 |
| 2014/0331456 | A1 * | 11/2014 | Wu | D04H 1/43838 19/305 |
| 2016/0076183 | A1 * | 3/2016 | Anderson | D04H 1/732 264/122 |
| 2018/0274142 | A1 * | 9/2018 | Kempster | D04H 3/05 |

FOREIGN PATENT DOCUMENTS

| | | | |
|---|---|---|---|
| EP | 2 238 281 | A1 | 10/2010 |
| EP | 2 799 607 | A1 | 11/2014 |
| EP | 2 558 631 | B1 | 7/2015 |
| WO | WO 2009/087236 | A1 | 7/2009 |

* cited by examiner

FACILITY FOR PRODUCING MINERAL WOOL

CROSS-REFERENCE TO RELATED APPLICATIONS

This application is the U.S. National Stage of PCT/FR2022/050371, filed Mar. 2, 2022, which in turn claims priority to French patent application number 2102034 filed Mar. 2, 2021. The content of these applications are incorporated herein by reference in their entireties.

The invention relates to the field of producing mineral wool, for example glass wool, and it relates more particularly to a facility for producing mineral wool comprising a station for distributing the mineral fibers on a conveyor belt of this facility.

Mineral wool producing facilities conventionally comprise several successive stations, including a fiberizing station, wherein mineral fibers, virgin or recycled, are formed, a station for mixing or sizing the mineral fibers thus formed with a binder, for example in liquid form, a station for distributing the mineral fibers on a conveyor belt, a calendering station, and a crosslinking station wherein the mat formed on the conveyor belt is transformed by the presence of mineral fibers and binder in order to form the mineral wool.

More particularly, it is known that the distribution station comprises means for guiding the assembly formed by the mineral fibers and the binder allowing this assembly to be distributed under suction, by following predominantly the aeraulics imposed by the adjustments of the fiberizing tools, to which are added compressed air jets in order to macroscopically distribute the clumps of fibers on the conveyor belt, and the mat thus formed is then directed towards an oven forming the calendering and crosslinking station, wherein the mat is successively dried and then subjected to a specific heat treatment which causes the polymerization (or "hardening") of the resin of the binder present on the surface of the fibers. The continuous mat of mineral wool is then intended to be cut in order to form, for example, thermal and/or acoustic insulation panels or rolls.

The thermal and/or acoustic insulation performance of these panels, consisting of nonwoven fibrous materials, depends in particular on the arrangement of the mineral fibers in the panel and therefore on the arrangement of the mineral fibers on the conveyor belt before they pass through the crosslinking station. It is thus understood that the configuration of the distribution station within the facility for producing mineral wools is essential.

Distribution stations are known from the prior art, and for example the application EP2238281, that are configured to allow the positioning of the fibers on the conveyor belt, with toothed rollers that make it possible to prevent fiber conglomerates formed in the mixing station with the binder from being disposed as-is on the conveyor belt. The fibers thus separated are then sucked via a suction chamber arranged on the other side of the conveyor belt so as to be deposited on this conveyor belt.

If distribution stations of this type make it possible to improve the distribution of fibers within the fiber mat, by preventing large heaps of fibers from being present locally while some areas of the mat are without fiber, the present invention aims to propose a facility greatly improving thermal insulation performance by seeking, in addition to the absence of clumps of mineral fibers within the mineral fiber mat, the optimization of the positioning of each of the mineral fibers within such a mat.

The present invention falls within this context and aims to propose a facility for producing mineral wool, comprising at least one supply device for supplying mineral fibers and a fiber-distribution station comprising a conveyor belt which can move in a longitudinal direction and on which the mineral fibers can be received so as to form a mineral fiber mat, characterized in that the fiber distribution station comprises a roller table arranged on the passage of the mineral fibers that are intended to fall by gravity onto the conveyor belt and wherein each roller can be driven in rotation about a transverse axis of rotation, the rollers being configured to orient the mineral fibers longitudinally on the conveyor belt.

According to a first aspect of the invention, the rollers are configured to ensure a longitudinal orientation of the mineral fibers on the conveyor belt, in particular by considering the distance between the rollers of the roller table and the surface of the conveyor belt on which the mineral fibers are deposited after having passed through the roller table, this distance subsequently being designated by the term "vertical clearance". This longitudinal arrangement is particularly advantageous for the thermal performance of the mineral wool thus manufactured.

The facility according to the invention is particularly aimed at the specific use of mineral fibers, whose dimensions, lightness, flexibility, for example are specific relative to other fibers such as wood fibers, which implies specific positioning of the rollers relative to the conveyor belt to ensure that the mineral fibers can assume a longitudinal orientation in the mineral fiber mat. A particular feature of these mineral fibers consists in particular in the fact that they easily constitute agglomerates of fibers by adhering to one another, so that the average length of a mineral fiber to be considered can vary. As a non-limiting example, mineral fibers alone may have an average length less than millimeters, but these mineral fibers entirely separated from the others may only represent a minimal share within the fibrous assembly arriving in the distribution station relative to clumps of fibers whose average length, depending on an average number of mineral fibers forming these clumps, may be on the order of 20 to 30 millimeters. It is therefore advantageous to provide a facility supporting this particular feature specific to mineral fibers, as the presence of a clump of fibers can moreover be increased when the mineral fibers used are recycled fibers, with binder residue sticking these mineral fibers to one another. The facility according to the invention can be configured as a function of an average dimension of a length of fibers or of clumps of fibers, in particular to adapt the vertical clearance value, that is, the distance between the rollers of the roller table and the surface of the conveyor belt onto which the fibers are deposited, and allow the large majority of the mineral fibers to be alone or in a clump, or correctly deposited on the conveyor belt.

The constitution of the mineral fibers, and in particular their flexible and deformable nature, can generate random orientations of these mineral fibers in the mineral fiber mat if these mineral fibers fall on the conveyor belt without being held and guided as long as possible by the rollers, and the facility according to the invention allows management of this feature resulting from the use of mineral fibers.

It is notable that according to the invention, the distribution station is free of fiber suction means, so that the distribution of the fibers is done only mechanically. The absence of such aeraulic means makes it possible to control the placement of the mineral fibers onto the conveyor belt and their orientation based on the cooperation of the rollers with the fiber mat.

According to one feature of the invention, the roller table comprises a plurality of rollers arranged in parallel with one another among which a proximal roller is arranged at one end of the roller table.

According to a feature of the invention, and the distribution station comprises means for mechanically guiding the mineral fibers in the direction of the proximal roller so that all the mineral fibers entering this distribution station are directed towards the conveyor belt so that they fall onto the proximal roller or between this proximal roller and the roller that is immediately adjacent thereto.

According to one feature of the invention, a vertical clearance between this proximal roller and the conveyor belt is less than a threshold value that depends on the average length of the mineral fibers treated by the facility.

As has been mentioned above, it should be noted that the concept of average length of the mineral fibers treated by the facility, according to the present invention, can equally refer to the average length of a mineral fiber alone, when it is correctly separated from the other mineral fibers, or to the average length of an average clump of fibers agglomerated together. According to a non-limiting example, the average length may more particularly be of the order of 20 to 30 millimeters, this value being more particularly representative of an observation made by the inventors of the average length of a clump of mineral fibers representatively present in the mineral fiber mat.

The vertical clearance is here measured between a peripheral surface of the proximal roller and the surface of the conveyor belt on which the mineral fibers are deposited. The rollers of the roller table can in particular be distinguished in that a proximal roller is arranged at a first end of the roller table, and more particularly the end closest to the supply device, in that a distal roller is arranged at the opposite end of the roller table and in that a plurality of central rollers are arranged successively between the proximal roller and the distal roller.

The fibers driven by the rotation of the proximal roller and passing between the proximal roller and the central roller immediately adjacent to the proximal roller are oriented by gravity in the direction of the conveyor belt, with a free end that ends in the direction of the mat and an end that remains in contact with the roller.

The average length of the mineral fibers and the vertical clearance of a value less than the threshold value equal to this average length value of the mineral fibers, which may be understood in a non-limiting manner as between 20 and 30 millimeters, make it possible to ensure that the free end of each mineral fiber passing through the roller table between the proximal roller and the immediately adjacent central roller enters into contact with the mat while it is still in contact with the roller. In this way, the free end of the mineral fiber being driven longitudinally by the passage of the conveyor belt, the mineral fiber is stretched and positioned longitudinally.

It should be noted that this characteristic whereby the vertical clearance value is less than a threshold value, here 30 millimeters, is similar for the other rollers of the roller table, while being measured this time between the axis of rotation of that other roller and the upper surface of the mineral fiber mat intended to rest on the conveyor belt in line with that roller. Therefore, in a similar manner to what has been mentioned above, the free end of each mineral fiber passing through the roller table between that other roller and the immediately adjacent roller comes into contact with the mineral fiber mat already present on the mat while it is still in contact with this other roller, which ensures the stretching and the longitudinal positioning of the mineral fiber.

According to one feature of the invention, the vertical clearance is measured between an external peripheral surface of the proximal roller and the conveyor belt.

According to one feature of the invention, a speed of movement of the conveyor belt is between 5 and 100 m/min so that the mineral fiber mat has a bulk density of between 5 and 40 kg/m3, more particularly between 6 and 35 kg/m3, even more particularly between 7 and 30 kg/m3.

As such, the facility is particular in that the mineral fiber mat obtained at the outlet of the distribution station has a bulk density of mineral fibers that is less than that of mats of other types of fibers, such as wood fibers, for example. This density is in particular obtained by modulating the areal density via the control of a speed of movement of the conveyor belt which allows the deposition of a given number of mineral fibers in a given time.

According to one feature of the invention, the mineral wool producing facility comprises a conveying belt arranged between the mineral fiber supply device and the mineral fiber distribution station so that mineral fibers at the outlet of the conveying belt are able to fall by gravity onto the conveying belt via a passage between the rollers of the roller table, the speed of movement of the conveyor belt being a function of the speed of movement of the conveying belt and of a desired bulk density of the mineral fibers in the fiber mat.

According to one feature of the invention, the roller table extends mainly along an axis inclined relative to the main extension plane of the conveyor belt. In other words, each roller of the roller table extends at a distance from the conveyor belt specific to it, with a gradual increase in this distance, considering the direction of movement of the conveyor belt, that is to say as the distance from the proximal roller of the roller table becomes greater. It should be noted that the thickness of the mineral fiber mat present on the conveyor belt tends to increase considering the direction of movement of the conveyor belt, and the tilt of the roller table is calculated so that each roller is at a vertical clearance value less than the chosen threshold value, relative to the surface directly in line with this roller, considering the thickness of the mineral fiber mat which is assumed to be under this roller.

According to a feature of the invention, the tilt of the roller table relative to the main extension plane of the conveyor belt is determined by an angle calculated as a function of the thickness of the mineral fiber mat intended to rest on the conveyor belt, so that the vertical clearance is constant between each of the rollers and the upper surface of the mineral fiber mat.

According to one feature of the invention, each roller of the roller table extends at a distance from the conveyor belt specific to it, with a gradual increase in this distance, considering the direction of movement of the conveyor belt.

According to one feature of the invention, the distribution station may comprise means for adjusting a tilt of the roller table and it may comprise, in an alternative or cumulative manner, means for adjusting the value of the vertical clearance between the roller table and the conveyor belt and/or the mineral fiber mat.

According to one feature of the invention, the distribution station is equipped with a deflector means configured to guide the mineral fibers at the outlet of the supply device, and in particular at the outlet of the conveying belt, to the conveyor belt. This deflector means can be movable in order to modify the zone of the roller table on which the mineral fibers and the associated binder are directed at the outlet of the conveying belt.

More particularly, the distribution station comprises mechanical means for directing the mineral fibers into an area of the roller table comprising the proximal roller. These mechanical means can in particular take the form of a tank forming a funnel, with a wide surface for receiving the fibers at the outlet of the supply device and in particular of the conveying belt, and a narrower surface opposite the conveyor belt, in line with the proximal roller. In this way, the mineral fibers are directed by gravity onto the desired area of the roller table, so that they can then move step by step from the proximal roller to the distal roller of the roller table. The rollers work sequentially for the fibers that do not pass directly between the first rollers, so that the fibers are distributed uniformly over the length of the roller table. It should be noted that such a distribution is not possible in prior art systems where the fibers are blown and sucked into a casing of the facility and are deposited on no particular zone of the conveyor belt after being randomly passed between one or the other pair of adjacent rollers.

In this context, the deflector means may consist of a wall of the mechanical means, the determined tilt of which makes it possible to slide the mineral fibers accurately onto the desired area of the roller table, namely the proximal roller or in the immediate vicinity of this proximal roller, or else consist of a movable wall at the outlet of the tank forming a funnel as previously mentioned, the tilt of which is adjusted by an actuator suitable for directing the mineral fibers onto the proximal roller or near it as a function of the quantity of fibers present on the proximal roller.

According to one feature of the invention, the rollers each have reliefs on their surface, arranged regularly along the axis of rotation of the rollers. It should be noted that the term "relief" is understood to mean both hollows and bumps, and more particularly grooves or protuberances, intended to break the regular profile of the peripheral surface of the rollers, in order to ensure the attachment and/or the detachment of the mineral fibers by these rollers.

According to other features of the invention, the rollers consist of toothed rollers, each tooth forming a radial protrusion of the roller body driven in rotation. At least one toothed roller comprises a plurality of teeth which are arranged annularly by being distributed regularly over the periphery of the roller.

The radial dimension of the teeth can be considered in order to calculate the value of the vertical clearance of the corresponding roller, to ensure, on the one hand, that the teeth can make it possible to ensure simultaneous contact between the mineral fibers and the conveyor belt or the fiber mat already formed and one of the teeth, in order to orient the fibers longitudinally and to ensure, on the other hand, that the teeth can be in contact with the fibers previously deposited on the conveyor belt and likely to not be correctly pressed on the surface of the mineral fiber mat, with the aim of finalizing the longitudinal orientation of the mineral fibers and through the thickness of the fiber mat. In other words, the vertical clearance can be measured between the conveyor belt, or the mineral fiber mat intended to rest on the conveyor belt, and the free radial end of the tooth closest to that conveyor belt. In particular, the vertical clearance can be measured between a radial end of a proximal roller tooth and the conveyor belt.

According to one feature of the invention, at least one roller comprises a plurality of toothed rings arranged parallel to one another along the transverse axis of rotation of the corresponding roller.

According to one feature of the invention, the mineral fiber supply device comprises means for supplying non-binding mineral fibers and a binder of the powder type or of the mineral fibers pre-coated with binder type, that is composed of a mineral fiber core and a coating that covers this core and comprising an unfired dried binder.

In one alternative embodiment, the conveying belt is arranged within a separation tank further comprising fiber separation means. It is understood from this configuration that the mineral fibers and the associated binder are treated in a first separation blank step in order to separate the most important fiber conglomerates and that the distribution station essentially has the function of distributing the separated fibers longitudinally into the mat, if appropriate by carrying out a separation finishing step for the few fibers that have not been separated from one another in the separation tank.

Other features, details and advantages of the present invention will emerge more clearly on reading the detailed description given below, by way of indication, in relation to the various embodiments of the invention shown in the figures, wherein.

As a reminder, the invention relates to the particular configuration of a station of a facility for producing mineral wool, and more particularly a mineral fiber distribution station configured to distribute mineral fibers in an appropriate orientation.

Figure 1:
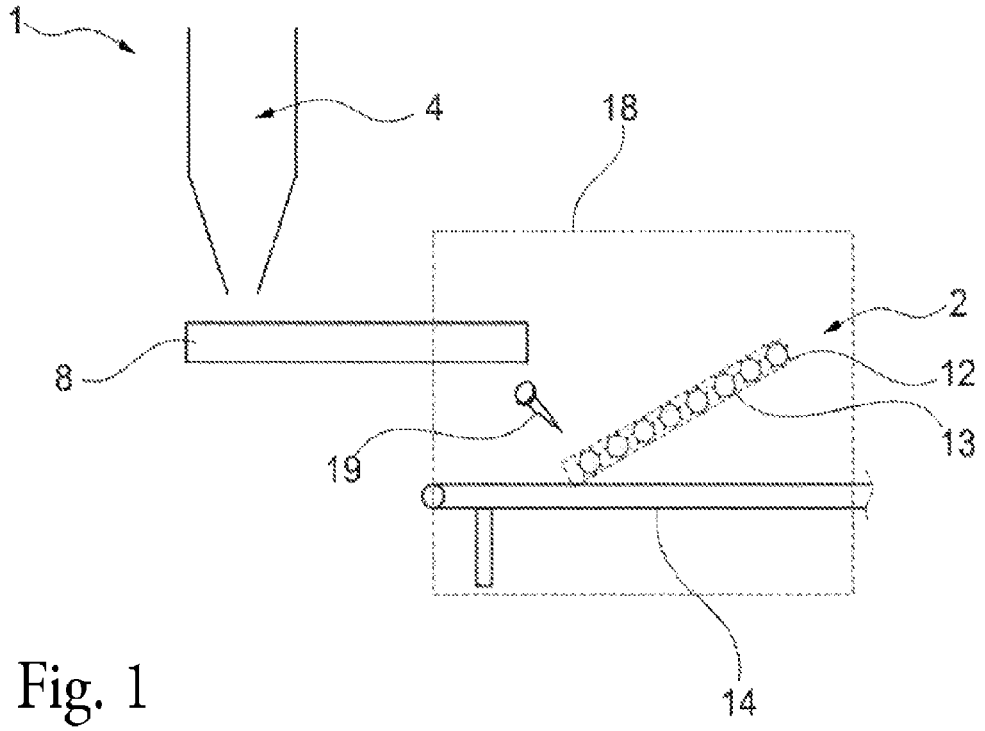
FIG. 1 is a schematic representation of part of a facility for producing mineral wool, showing in particular the mineral fiber distribution station in accordance with one aspect of the invention.

FIG. 1 shows a part of such a facility 1 for producing mineral wool, for example glass wool, with various successive stations participating in the creation of an insulating mat composed of mineral fibers and more particularly the specific distribution station 2 according to the invention.

Upstream of this distribution station, if the direction of circulation of the mineral fibers within the facility is considered, a first station comprises a fiber supply device 4 wherein mineral, virgin or recycled fibers are mixed, and a binder capable of ensuring that the fibers hold together when the mixture is heated at the end of facility. If necessary, the recycled mineral fibers are for example mineral fibers manufactured for an application of blowing wool, or else transformed fibers in the form of mineral wool for thermal and/or acoustic insulation. In the latter case, the recycled mineral fibers already comprise a hardened binder which does not prevent it from being treated by the same method, namely by adding another binder subsequently.

In the remainder of the description, when mention will be made of mineral fibers able to pass through a roller table and to be deposited on a conveyor belt in the distribution station, it is possible to refer equally to virgin mineral fibers or to recycled mineral fibers, or to mineral fibers mixed with binder or to with mineral fibers pre-coated with binder, whether for one mineral fiber alone, perfectly separated from the other mineral fibers, or else a clump of multiple intermingled fibers.

The term "virgin mineral fiber" may in particular denote here a mineral fiber, in particular a glass wool or rock wool fiber, obtained by internal or external centrifugation, the fibers of which are not bonded to one another by means of an organic binder. The fibers of virgin mineral wool can be coated with a thin layer of sizing or lubricant. The term "recycled mineral fiber" here refers to mineral fiber bearing on its surface an insoluble and infusible organic binder, already crosslinked. Of course, it may be envisaged that the mineral fibers present in the distribution station are a mixture of virgin mineral fibers and recycled mineral fibers, in any respective proportions.

The fiber supply device comprises at the outlet a supply duct connected to a conveying belt 8. The conveying belt 8 is configured to move at a first run speed, which can be modified by an appropriate control instruction. The conveying belt 8 has a fiber distribution end 9 which is arranged overhanging the distribution station 2 mentioned above.

The distribution station 2 comprises at least one roller table 12 equipped with rollers 13 and a conveyor belt 14 on which a fiber mat 15 may form, as the mineral fibers and the binder are deposited on the conveyor belt. The roller table 12 is arranged on the path of the mineral fibers between the conveying belt 8 and the conveyor belt 14.

The roller table is formed by a plurality of rollers 13 arranged in parallel with each other and able to pivot about axes of rotation parallel to one another. As will be detailed below, these rollers 13 are configured to make it possible on the one hand to carry out a separation of the mineral fibers and to avoid the deposition of mineral fibers agglomerated on the conveyor belt and on the other hand to produce a longitudinal orientation of these mineral fibers, perpendicular to the axis of rotation of the rollers, within the fiber mat 15. In other words, the distribution station 2 is configured to separate the mineral fibers 3 from one another for the mineral fibers which would not have been completely separated in the separation tank, in particular by the arrangement of rollers in roller table within which the rollers 13, which rotate in the same direction of rotation, participate in directing some of the mineral fibers 3 between two adjacent rollers toward the conveyor belt and another part of the fibers toward the adjacent roller to advance along the roller table and be poured further onto the conveyor belt.

Figure 2:
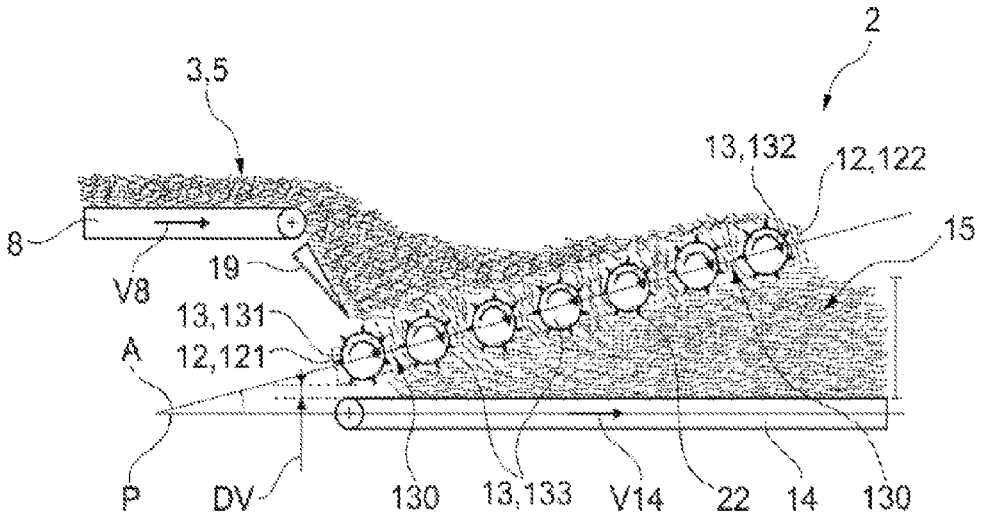
FIG. 2 is a schematic representation of the distribution station of FIG. 1, according to the invention with a roller table and a conveyor belt that are arranged at a distance from each other to allow the rollers to orient the mineral fibers during their deposition onto the conveyor belt.
Figure 6:
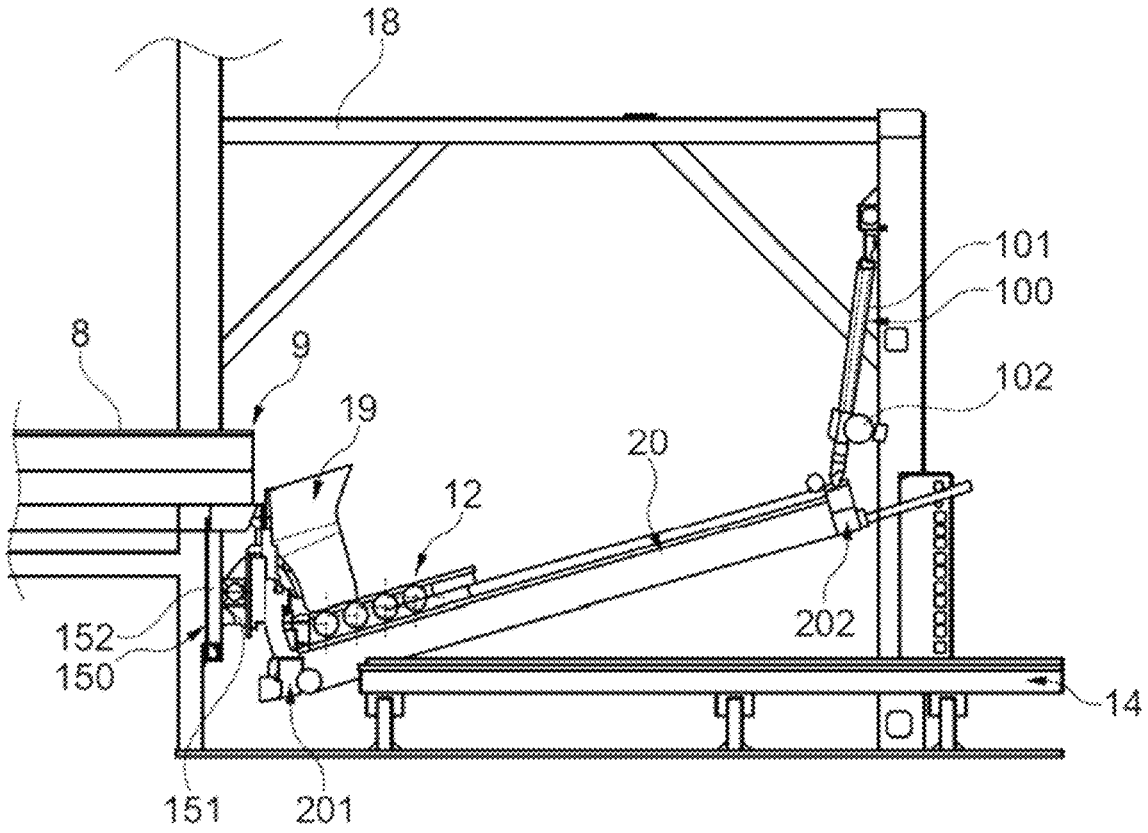
FIG. 6 is a schematic representation of an alternative version of the distribution station of FIG. 1, according to the invention with a roller table and a conveyor belt that are arranged at a distance from each other to allow the rollers to orient the mineral fibers during their deposition onto the conveyor belt.

As has been mentioned, the conveying belt 8 has a fiber distribution end 9 which is arranged overhanging the distribution station 2 and therefore the roller table 12. In this roller table, a proximal roller 131, arranged at a first end 121 of the roller table 12 closest to the conveying belt 8, a distal roller 132 arranged at the opposite end 122 of the roller table 12, and a plurality of central rollers 133 arranged successively between the proximal roller and the distal roller, are all distinguished. The distribution station comprises mechanical guiding means for guiding the mineral fibers arriving at the fiber distribution end 9 towards the roller table 12 and more particularly in the direction of the proximal roller 131. These mechanical guiding means can take various forms, among them a flexible duct, a rigid tank forming a funnel as shown in FIG. 6 or a guide ramp as shown in FIGS. 1 and 2, these mechanical guiding means consisting of guiding, in particular toward the proximal roller 131 and the immediately adjacent rollers, the mineral fibers falling under gravity into an environment where they are neither blown nor sucked.

The distribution station is also configured to give these mineral fibers 3 a longitudinal orientation, that is parallel to the direction of movement of the conveyor belt, this longitudinal orientation of the mineral fibers 3 in the mat 15 being optimal in terms of thermal insulation.

More particularly, the distribution station 2 makes it possible to give this optimal longitudinal orientation of the mineral fibers, in particular by the dimension of the rollers and their arrangement of the rollers relative to the conveyor belt, and the impact that this can have on the way the fibers are caused to be deposited on the conveyor belt, instead of falling onto it as can be the case in the facilities of the prior art. The mineral fibers 3 and the mineral fibers 5 pre-coated with binder, or if necessary, the fibers bonded by a liquid binder or in powder form, are deposited on the conveyor belt 14, being deposited on the surface of this conveyor belt after being passed between two adjacent rollers 13, under conditions that ensure a longitudinal drive and stretching, and by being combed at the surface of the fiber mat 15 by the contact of the rollers of the roller table 12, as will be detailed below.

The conveyor belt 14 is extended by a conveying belt, which leads the mat 15 composed of these mineral fibers 3 and the binding elements 5 to an oven, not shown here, and inside which they are heated to crosslink the binder.

It will be understood that such a facility line is suitable for the production of products based on glass wool fibers, as will be described, but that it is obviously suitable for the production of products based on mineral fibers.

More particularly, the distribution station and the roller table that it comprises are suitable for the treatment, and as mentioned above for orienting fibers relative to one another, of mineral fibers and for example glass fibers, which have specific dimensions and the average length of which may in particular vary as a function of the dimension of the clump that they are part of, where appropriate with other mineral fibers, these mineral fibers being more particularly intended to clump than other fibers such as wood fibers, and/or able to consist of recycled mineral fibers clumped together by dried binder residue.

The configuration of the roller table 12 is also particularly suitable for an assembly formed from mineral fibers 3 and binder 5 wherein the binder is formed by fibers pre-coated with binder. The roller table thus allows an optimal arrangement of the mineral fibers and the pre-coated fibers in the fiber mat falling onto the conveyor belt.

The pre-coated fibers are more particularly here fibers composed of a core made of mineral fibers, advantageously the same mineral fiber as the non-binding mineral fibers present and a shell surrounding the core which is made with a sprayed and dried binder.

The binder may in particular consist of a binder with a low formaldehyde content, preferably even without formaldehyde, for example binders based on biosourced products. This type of binder is at least partially derived from a base of renewable raw materials, in particular plant-based ones, in particular of the type based on hydrogenated or non-hydrogenated sugars.

The fact that the binder is implemented via a pre-coated mineral fiber, based on a mineral fiber similar to that treated elsewhere in the facility, makes it possible to treat the arrangement of the binder in the mineral fiber mat in a similar way to that of the non-binding fibers.

The fiber distribution station 2 according to one aspect of the invention will now be described in more detail, in particular with reference to FIGS. 2 to 5.

The fiber distribution station 2 comprises, in addition to the roller table 12 and the conveyor belt 14 mentioned above, at least one casing 18 and a support 20 of the roller table.

The casing 18 is delimited by a plurality of walls inside which the mineral fibers and the associated binder are directed, from the conveying belt 8, to the conveyor belt 14, by passing through the roller table 12.

One or more mechanical guiding means 19, and for example a deflector as shown in FIGS. 1 and 2 or a tank as shown in FIG. 6, can be provided to guide the mineral fibers arriving at the fiber distribution end 9 towards the roller table 12 and more particularly in the direction of the proximal roller 131. These mechanical guiding means can be arranged projecting from one or more walls of the casing 18 to guide the non-binding mineral fibers and the binder towards the rollers 13 of the roller table 12. More particularly, the deflector means may be movable, in order to be able to modify the zone of the roller table on which the mineral fibers falling from the conveying belt are directed, it being understood that these mineral fibers falling by gravity are mainly directed via the mechanical guide means 19 toward the zone of the roller table 12 comprising the proximal roller and therefore the zone substantially in line with the fiber distribution end 9 of the conveying belt 8.

As shown in FIG. 6, the tank forming the mechanical guiding means 19 may have a funnel shape with an upper wide end opening to recover a large amount of mineral fibers falling at the end of the conveying belt and a lower end whose opening is reduced relative to the upper end to target the desired area for depositing the fibers on the roller table, namely the zone immediately close to the proximal roller 131.

The support 20 of the roller table herein has the shape of a frame attached to the walls of the casing 18 to ensure the position of the rollers 13 relative to the casing, if necessary via means for adjusting the tilt of the rollers. The support of the roller table is configured so that all of the fibers come into contact with the roller table 12.

The support 20 is configured so that the roller table 12 is inclined relative to the conveyor belt 14. In other words, the rollers are arranged parallel to each other along an axis A of the roller table which is inclined relative to a plane P wherein the surface of the conveyor belt extends, on which the mineral fiber mat rests. As has been mentioned, means for adjusting the tilt of the rollers 100 can be provided and associated with the support 20 of the roller table to reduce or increase the angle of tilt a between the axis A of the roller table and the plane P of the conveyor belt.

FIG. 6 more particularly shows an example embodiment of means for adjusting the tilt of the rollers 100, it being understood that this example is non-limiting and that the tilt adjustment means could take another form. The means for adjusting the tilt 100 here comprise a chain or belt 101, attached on the one hand to an upright of the casing 18 and on the other hand to a distal end 202 of the support 20 of the roller table, whereas the opposite proximal end 201 of the support 20 is fixed relative to the casing 18 at a height less than the height of fastening of the chain or belt to the upright of the casing. The means for adjusting the tilt further comprise means for adjusting the length of the chain or belt, and for example a motor 102 engaged on the belt or the chain, the actuation of which makes it possible to reduce or increase the length of the chain or belt between the upright of the casing and the distal end 202 of the support 20, and thus to lower or lift that distal end 202 and accordingly generate the desired tilt of the support 20 and the roller table 12.

It may in particular be provided a tilt of the roller table relative to the plane P of the conveyor belt on the order of 1° to 30°, preferably between 5 and 20°. This tilt can be fixed throughout the mineral wool producing process, the tilt value being chosen as a function of the thickness of the mineral fiber mat that it is desired to obtain at the end of the conveyor belt before firing. The operator orients the roller table support according to the desired tilt using the tilt adjustment means 100, then the operator sets the position of this support before the start of the producing process. Alternatively, the adjustment means 100 could be automated, with automatic control of the position of the distal end 202 of the support as a function of the tilt to be given to the roller table being processed, in particular if any facility data are modified.

This tilt value of the roller table may in particular be dependent on the speed of the conveyor belt. More particularly, the lower the speed of the conveyor belt, the higher the angle of tilt of the roller table. The rollers 13 of the roller table 12 are here identical, and each comprise the same number of teeth 22 regularly distributed along the periphery of the rollers.

As mentioned above, from the roller table a proximal roller 131, arranged at a first end 121 of the roller table 12 closest to the conveying belt 8, a distal roller 132 arranged at the opposite end 122 of the roller table 12, and a plurality of central rollers 133 arranged successively between the proximal roller and the distal roller, are all distinguished.

The rollers 13 are rotated, all in the same direction of rotation, so as to allow the progression of the mineral fibers 3 from one end to the other of the roller table, with part of these fibers passing between the rollers 13 to fall onto the conveyor belt 14. It is possible to define an upper part of the rollers and a lower part of the rollers as a function of their position relative to a median plane of the roller table, the lower part being the part of the rollers closest to the conveyor belt and of the fiber mat, and it is possible to define the direction of rotation of the rollers such that the upper part of the rollers rotates from the first end to the opposite end of the support.

An impurity discharge device, not shown here, may comprise a suction hood which is arranged at the end of the roller table support and which is configured to suck the fiber conglomerates that could not be separated by the action of the rollers of the roller table.

As can be mentioned above, the distribution station 2 according to the invention has technical characteristics and dimensions of the various components of this station that are specific to an application for mineral fibers 3 sized with a binder 5 in powder form or with mineral fibers pre-coated with binder. Several of these features are in particular visible in the representation of FIG. 2.

According to the invention, the distribution station 2 is configured to allow a longitudinal orientation of the mineral fibers within the fiber mat. To this end, the vertical clearance DV between the proximal roller 131 of the roller table and the conveyor belt 14, that is the minimum distance between the components of this proximal roller 131 and the conveyor belt, has a value less than a threshold value depending on the type of fibers brought to be deposited on the conveyor belt, and therefore here depending on a dimension of the mineral fibers. The vertical clearance may in particular be measured between the external peripheral surface of the proximal roller and the conveyor belt. The vertical clearance DV here is less than 30 millimeters. Such a vertical clearance value, here even smaller than that which could be implemented in applications with wood fibers, ensures that the mineral fibers, after having passed through the roller table, remain in contact with the roller at one end thereof when they are deposited on the conveyor belt. As will be detailed below, this makes it possible to ensure a longitudinal orientation of the fibers on the conveyor belt, parallel to the forward axis of the conveyor belt.

Means for adjusting the vertical clearance 150 can be provided to adjust, at least upon starting the method for producing mineral wools, the value of the vertical clearance DV and adapt it as a function of the average fiber lengths intended to fall onto the roller table 12 via the conveying belt 8 and the mechanical guiding means 19. FIG. 6 more particularly shows an example embodiment of means for adjusting the vertical clearance 150, it being understood that this example is non-limiting and that the vertical clearance adjustment means could take another form. The vertical clearance adjustment means 150 here comprise a plate 151 secured to the proximal end 201 of the support 20, said plate 151 being mounted on a rail 152 integral with an upright of the casing 18. The vertical movement of the plate 151 along the rail 152 makes it possible to adjust the vertical position of the proximal end 201 of the support 20 and therefore the position of the proximal roller 131 relative to the conveyor belt 14 that remains fixed thereto. Once the desired vertical position is reached, the position of the proximal end 201 of the support 20 is fixed by fastening the plate to the upright of the casing.

In order to take into account the thickness of the fiber mat 15 which increases as it advances on the conveyor belt, the roller table 12 is inclined in accordance with what has been mentioned. In this way, the characteristic concerning the maximum vertical clearance DV mentioned for the proximal roller, namely a maximum distance at which the proximal roller 131 extends from the surface of the conveyor belt 14 onto which the mineral fibers that this proximal roller can drive can be deposited, can be reproduced for each of the rollers of the roller table 12, this time considering the surface of the fiber mat 15 rather than the surface of the conveyor belt 14, the roller table 12 being configured so that the fibers that the central rollers 133 and the distal roller 132 drive are deposited on a mineral fiber mat already present on the conveyor belt.

Another feature of the facility and of the distribution station is specific to the use of mineral fibers, namely the speed of movement V14 of the conveyor belt 14. This speed of movement V14 makes it possible on the one hand to drag and stretch the mineral fibers 3 still in contact with the roller 13 which participated in the passage through the mineral fibers of the roller table, and it is calculated to allow the production of mineral fiber mats having a fiber density of less than 40 kg/m3. As a non-limiting example, the speed of movement of the conveyor belt can be on the order of 5 to 100 meters per minute. Furthermore, for the production of mats with such a density, the speed of movement V8 of the conveying belt 8 bringing the mineral fibers in contact with the roller table and the differential of movement speeds between the conveyor belt and the conveying belt may also be considered.

Figure 3:
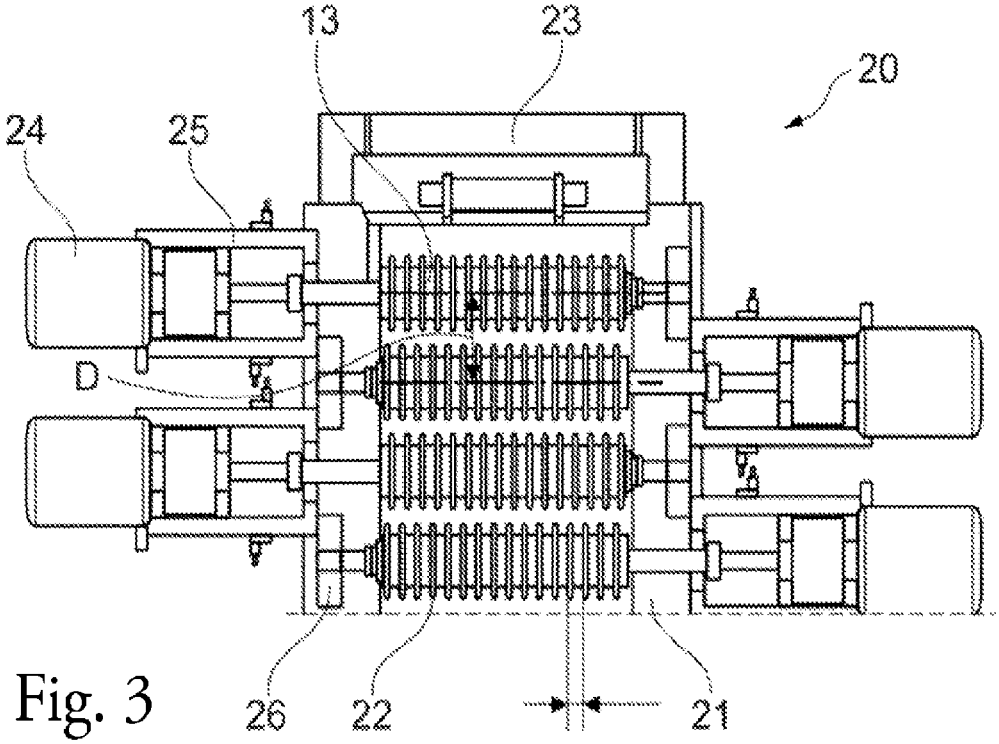
FIG. 3 is a detailed view of the roller table of FIG. 2, in a top view.

FIG. 3 makes the support 20 of the roller table more particularly visible.

The frame of the support 20 has a rectangular shape, with two large sides 21 perpendicular to the axis of rotation of the rollers and two small sides 23 connecting these large sides. On the large sides are arranged clevises 25 for securing the motorized drive means 24 and rotation bearings 26 associated with each of the rollers 13, with alternately on the same large side a clevis and a rotation bearing.

Each roller 13 has on the surface, that is to say on its external peripheral surface arranged around the axis of revolution, reliefs that are arranged regularly along the axis of rotation of the rollers in order to break the regular profile of the peripheral surface of the rollers, in particular to control the interaction between the mineral fibers and these rollers.

In the example shown, the reliefs are formed by a plurality of teeth 22. In other words, each roller 13 comprises teeth forming projections arranged in successive parallel rings on the axial dimension of the roller, the rings of teeth 22 being separated from each other along a same roller of a pitch 220. It is notable in the top view of FIG. 4 that the rollers 13 are arranged so that the rings of teeth 22 of two adjacent rollers are axially offset, to avoid any interaction between the teeth of two adjacent rollers during their rotation.

Figure 4:
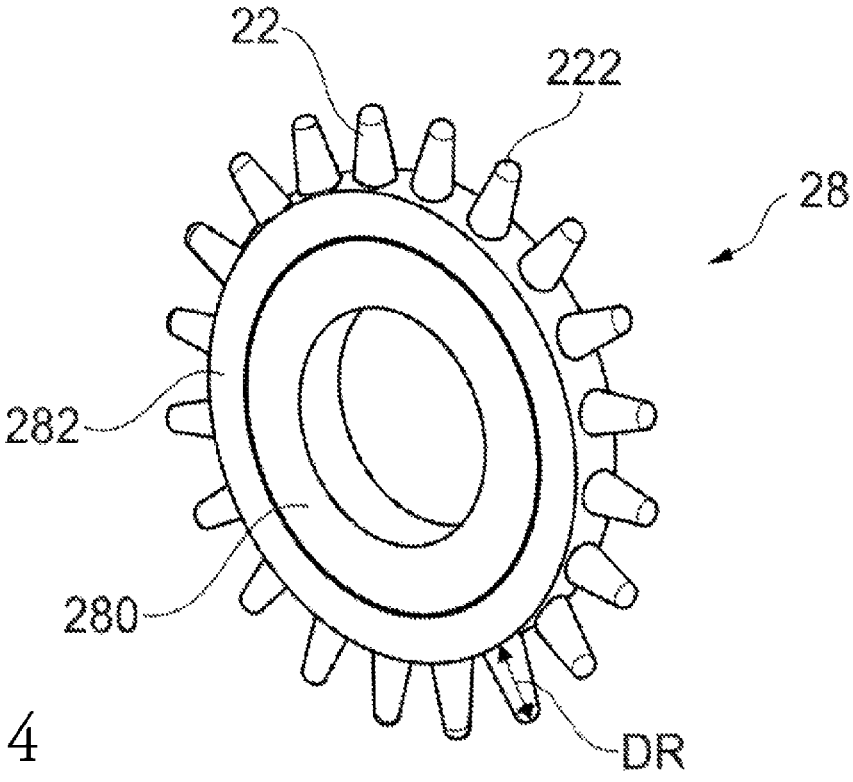
FIG. 4 is a perspective representation of a toothed ring forming part of a toothed roller of the roller table of FIG. 3.

Each roller 13 may in particular be formed by a plurality of toothed rings 28 pressed against one another along the axial dimension of the roller. As shown in FIG. 4, such a ring 28 may comprise a ring body 280 able to be secured to the rotating shaft of the roller and a toothed peripheral portion 282, and these two parts of the ring can advantageously be made up of two different materials from one part to the other. The toothed portion may for example be overmolded onto the ring body, with means for fastening by mating shapes.

Each ring of teeth 22, and in particular when it is formed by a toothed ring 28 visible in FIG. 4, comprises teeth 22 regularly distributed angularly, here numbering twenty, the teeth thus being characterized by an angular pitch, here on the order of 18°, between two successive teeth on the periphery.

Each tooth 22 protrudes from an outer surface of the ring, a radial dimension DR of the tooth being measured between the free end 222 of the tooth and the outer surface of the ring.

The teeth 22 are in particular dimensioned so that their free ends 222 can comb the mineral fibers 3 not yet pressed on the surface of the mineral fiber mat 15, when the teeth pass during their rotation between the conveyor belt and the median plane of the roller table comprising the axes of rotation of the rollers.

A spacing 130 of the rollers is determined by considering the center distance D between the axes of rotation of two adjacent rollers and the radial dimension DR of the teeth, in particular visible in FIG. 4, the spacing being measured between the free end of the teeth of a roller and the adjacent roller.

As is the result of the foregoing detailed description, the invention addresses the technical problem of orienting mineral fibers in the fiber mat to be directed toward the cross-linking station, in particular by providing a particular configuration of the rollers at a short distance from the conveyor belt, and more particularly here less than 30 millimeters from the conveyor belt for the proximal roller and less than 30 millimeters from the surface of the mat formed by the mineral fibers likely to be present on the conveyor belt in line with the other rollers. This configuration makes it possible to deposit the mineral fibers on the conveyor belt with ends of the mineral fibers that are simultaneously in contact with the conveyor belt and the rollers, which avoids having to release the fibers far from the conveyor belt as in the prior art whereupon they are haphazardly deposited, under the effect of gravity, onto the conveyor belt. The simultaneous contact of the mineral fibers with the conveyor belt or the fiber mat and one of the rollers makes it possible to stretch the fibers and to position them in an optimal longitudinal position for the thermal insulation of the mineral wool obtained after crosslinking the fiber mat.

This longitudinal arrangement of the mineral fibers on the conveyor belt can even better be ensured when the rollers comprise teeth and that they are positioned and dimensioned to comb the surface of the mineral fiber mat and more particularly the mineral fibers likely to protrude from this surface of the mat, in a reverse combing direction to that of the direction of movement of the conveyor belt.

These characteristics and resulting advantages are more precisely detailed with reference to FIG. 5, which schematically shows the action of the rollers, here toothed rollers, on the fibers to orient them longitudinally.

As mentioned, the proximal roller 131 is arranged at a distance from the conveyor belt 14 such that a vertical clearance DV is less than a minimum value chosen as a function of the dimensions of the mineral fibers 3 intended to be deposited on the conveyor belt 14. The value of the angle of tilt of the axis wherein the roller table 12 extends, relative to the surface of the conveyor belt, makes it possible to ensure that the other rollers are arranged so that an equivalent vertical clearance DV, that is to say one that is less than the minimum value chosen as a function of the dimensions of the mineral fibers 3, is formed between the roller and the upper surface of the fiber mat formed on the conveyor belt in line with said roller.

In this configuration, if we refer to the schematic representation of the proximal roller 131 and of a first mineral fiber 31 passing through the roller table 12 between this proximal roller and the adjacent central roller, the rollers are sized, and where appropriate the teeth forming radial projections of the roller body, and arranged at a distance from the conveyor belt such that the first mineral fiber 31 is deposited on the conveyor belt or on first mineral fibers already present on the mat while one end of that first mineral fiber is still in contact with a part of the proximal roller 131, here a tooth 22. In this way, it is notable that according to the invention, the mineral fibers are in simultaneous contact with the roller and the conveyor belt, or the fiber mat present on the conveyor belt, at the time of their deposition on the conveyor belt. The fibers driven by the rotation of a roller and passing between that roller and the central roller immediately adjacent to that roller are oriented by gravity in the direction of the conveyor belt, with a first free end that ends in the direction of the mat and a second end that remains in contact with the roller.

The average length of the mineral fibers, determined as being substantially on the order of 30 millimeters as previously mentioned, and the vertical clearance having a value less than this average length value of the mineral fibers, here 30 millimeters, make it possible to ensure that the free end of each mineral fiber passing through the roller table between the proximal roller and the immediately adjacent central roller enters into contact with the mat while it is still in contact with the roller. In this way, the free end of the mineral fiber being driven longitudinally by the passage of the conveyor belt, the mineral fiber is stretched and positioned longitudinally.

Figure 5:
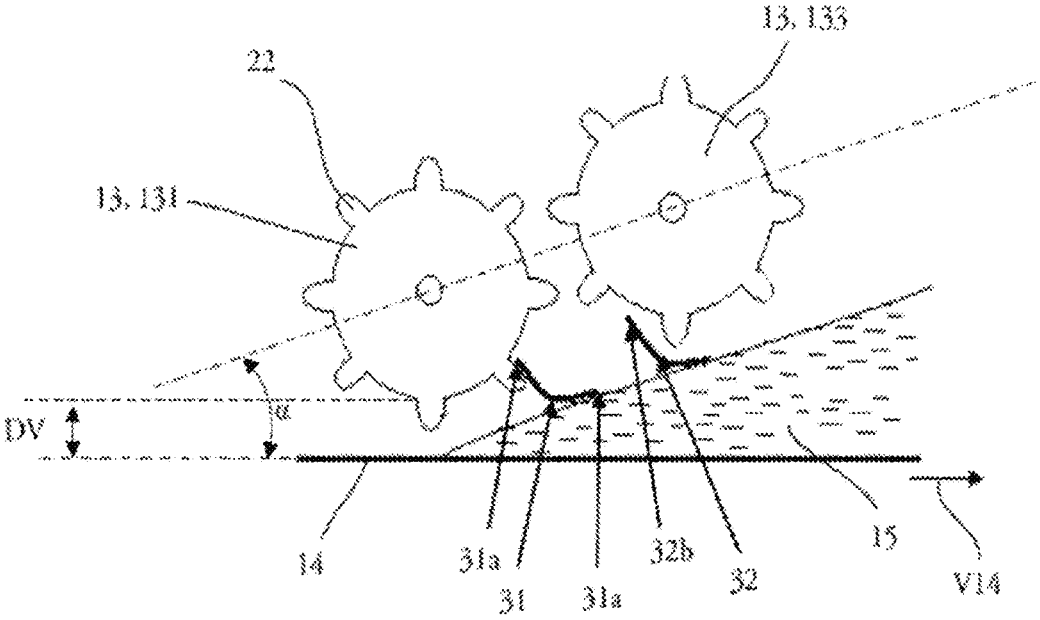
FIG. 5 is a schematic representation of two toothed rollers of the roller table aiming to show the cooperation of these rollers with a mineral fiber mat formed on the conveyor piece.

If reference is made to the first mineral fiber 31 shown in FIG. 5, the mineral fibers are drawn by the movement of the conveyor belt, which in the example shown brings a first free end 31*a* of the first mineral fiber 31 into a direction, and by the rotation of the roller, which in the example shown tends to bring the second free end 31*b* into the other direction or which at least tends to retain that second free end 31*b*.

Each mineral fiber thus deposited on the conveyor belt or on the fiber mat takes a main longitudinal orientation, with the first free end 31*a* pressed against the fiber mat. It may result from the deposition of the mineral fiber once released by the roller, as shown in FIG. 5 for a second mineral fiber 32, that the second free end 32*b* of this second mineral fiber remains raised and is not pressed against the surface of the fiber mat. The arrangement of the roller table, with central rollers and the distal roller which are arranged according to a vertical clearance less than the previously mentioned threshold value, enables a function of combing this second mineral fiber, and more generally all of the mineral fibers not yet pressed on the surface of the mineral fiber mat, the rotational movement of the lower part of the roller, and in particular of the teeth 22, tending to push the second end of the teeth back toward the conveyor belt.

In general, the embodiment which was described above is in no way limiting: it is in particular possible to imagine variants of the invention comprising only a selection of the described features isolated from the other features mentioned in this document, if such a selection of features is sufficient to confer a technical advantage or to differentiate the invention from the state of the prior art.

By way of example, in an alternative embodiment not shown and without this being limiting on the number of variants that can be envisaged, the facility comprises a separation tank wherein the conveying belt can be arranged and which comprises separation means, not shown here, which allow a first step of separation of the fibers, in particular to avoid large clumps of fibers. These separation means may in particular consist of toothed rollers and/or blowing means. The fiber separation tank is configured so that the fibers treated by the separation means penetrate into a fiber feed duct connecting the separation tank to the distribution station mentioned above. In particular, the fiber feed duct can be configured to allow the fibers treated by the separation means to fall under gravity.

The invention claimed is:

1. A facility for producing mineral wool, comprising at least one supply device for supplying mineral fibers and a fiber distribution station comprising a conveyor belt which is movable in a longitudinal direction and on which the mineral fibers are receivable so as to form a mineral fiber mat, wherein the fiber distribution station comprises a roller table arranged on a passage of the mineral fibers that are intended to fall by gravity onto the conveyor belt, the roller table comprising a plurality of rollers, wherein each roller is adapted to be driven in rotation about a transverse axis of rotation, the plurality of rollers being configured to orient the mineral fibers longitudinally on the conveyor belt, wherein the roller table extends mainly along an axis inclined relative to a main extension plane of the conveyor belt, and wherein a tilt of the roller table relative to the main extension plane of the conveyor belt is determined by an angle calculated as a function of a thickness of the mineral fiber mat intended to rest on the conveyor belt, so that a vertical clearance is constant between each of the plurality of rollers and the conveyor belt and/or the mineral fiber mat.

2. The facility for producing mineral wool according to claim 1, wherein the fiber distribution station comprises means for mechanically guiding the mineral fibers in a direction of a proximal roller arranged at one end of the roller table so that all the mineral fibers entering the fiber distribution station are directed towards the conveyor belt so that the mineral fibers fall onto the proximal roller or between the proximal roller and the roller that is immediately adjacent thereto.

3. The facility for producing mineral wool according to claim 1, wherein the vertical clearance between a proximal roller arranged at one end of the roller table and the conveyor belt is less than a threshold value depending on an average length of the mineral fibers treated by the facility, the vertical clearance between the proximal roller and the conveyor belt being is-measured between an external peripheral surface of the proximal roller and the conveyor belt.

4. The facility for producing mineral wool according to claim 1, wherein a speed of movement of the conveyor belt is between 5 and 100 m/min so that the mineral fiber mat has a bulk density of between 5 and 40 kg/m$^3$.

5. The facility for producing mineral wool according to claim 1, wherein the roller table extends mainly along an axis inclined relative to a main extension plane of the conveyor belt.

6. The facility for producing mineral wool according to claim 1, wherein the fiber distribution station comprises means for adjusting the tilt of the roller table.

7. The facility for producing mineral wool according to claim 1, wherein the fiber distribution station comprises means for adjusting a value of the vertical clearance.

8. The facility for producing mineral wool according to claim 1, wherein the plurality of rollers each have reliefs on their surface, arranged regularly along the axis of rotation of each of the plurality of rollers.

9. The facility for producing mineral wool according to claim 1, wherein the plurality of rollers consist of toothed rollers each including a roller body and teeth, each tooth forming a radial protrusion of the roller body driven in rotation.

10. The facility for producing mineral wool according to claim 9, wherein the vertical clearance between a proximal roller at an end of the roller table and the conveyor belt is less than a threshold value depending on an average length of the mineral fibers treated by the facility, and wherein the vertical clearance is measured between a radial end of a tooth of the proximal roller and the conveyor belt.

11. The facility for producing mineral wool according to claim 9, wherein at least one roller comprises a plurality of toothed rings arranged parallel to one another along the transverse axis of rotation of the corresponding roller.

12. The facility for producing mineral wool according to claim 1, wherein the supply device for supplying mineral fibers comprises means for supplying non-binding mineral fibers and a binder in powder form or mineral fibers pre-coated with binder.

13. The facility for producing mineral wool according to claim 1, wherein the fiber distribution station is free of suction means and the distribution of the mineral fibers onto the conveyor belt is performed solely by gravity and mechanical action of the rollers.

14. A facility for producing mineral wool, comprising at least one supply device for supplying mineral fibers and a fiber distribution station comprising a conveyor belt which is movable in a longitudinal direction and on which the mineral fibers are receivable so as to form a mineral fiber mat, wherein the fiber distribution station comprises a roller table arranged on a passage of the mineral fibers that are intended to fall by gravity onto the conveyor belt, the roller table comprising a plurality of rollers, wherein each roller is adapted to be driven in rotation about a transverse axis of rotation, the plurality of rollers being configured to orient the mineral fibers longitudinally on the conveyor belt, wherein the roller table extends mainly along an axis inclined relative to a main extension plane of the conveyor belt, and wherein each roller of the roller table extends at a vertical distance from the conveyor belt specific to said roller, with a gradual increase in said vertical distance between two adjacent rollers of the roller table, considering the direction of movement of the conveyor belt.

15. The facility for producing mineral wool according to claim 14, wherein the fiber distribution station is free of suction means and the distribution of the mineral fibers onto the conveyor belt is performed solely by gravity and mechanical action of the rollers.

16. The facility for producing mineral wool according to claim 14, wherein the fiber distribution station comprises means for mechanically guiding the mineral fibers in a direction of a proximal roller arranged at one end of the roller table so that all the mineral fibers entering the fiber distribution station are directed towards the conveyor belt so that the mineral fibers fall onto the proximal roller or between the proximal roller and the roller that is immediately adjacent thereto.

17. The facility for producing mineral wool according to claim 14, wherein a vertical clearance between a proximal roller arranged at one end of the roller table and the conveyor belt is less than a threshold value depending on an average length of the mineral fibers treated by the facility, the vertical clearance between the proximal roller and the conveyor belt being measured between an external peripheral surface of the proximal roller and the conveyor belt.

18. The facility for producing mineral wool according to claim 14, wherein a speed of movement of the conveyor belt is between 5 and 100 m/min so that the mineral fiber mat has a bulk density of between 5 and 40 kg/m$^3$.

19. The facility for producing mineral wool according to claim 14, wherein the fiber distribution station comprises means for adjusting a tilt of the roller table.

20. The facility for producing mineral wool according to claim 14, wherein the fiber distribution station comprises means for adjusting a value of a vertical clearance between the roller table and the conveyor belt and/or the mineral fiber mat.

* * * * *